United States Patent [19]

Ward

[11] 4,453,472

[45] Jun. 12, 1984

[54] RACK STRUCTURE

[75] Inventor: Leonard H. Ward, La Canada, Calif.

[73] Assignee: M. E. Canfield Company, Los Angeles, Calif.

[21] Appl. No.: 350,755

[22] Filed: Feb. 22, 1982

[51] Int. Cl.[3] ..... A47F 5/10

[52] U.S. Cl. ..... 108/107; 211/191; 248/243

[58] Field of Search ..... 108/114, 107, 111; 211/191, 192, 193

[56] References Cited

U.S. PATENT DOCUMENTS

| | | | |
|---|---|---|---|
| 1,952,111 | 3/1934 | Bales | 108/107 |
| 2,984,363 | 5/1961 | Lang | 211/191 |
| 3,428,187 | 2/1969 | Baggott | 248/243 X |
| 3,659,884 | 5/1972 | Ohlin | 211/191 X |
| 3,724,678 | 4/1973 | Challier | 211/191 |
| 3,788,490 | 1/1974 | Featherman | 211/191 |
| 4,158,998 | 6/1979 | Clement | 211/191 X |
| 4,349,171 | 9/1982 | Baldwin | 248/243 |

FOREIGN PATENT DOCUMENTS

| | | | |
|---|---|---|---|
| 1214842 | 4/1966 | Fed. Rep. of Germany | 211/191 |

*Primary Examiner*—William E. Lyddane
*Assistant Examiner*—Peter A. Aschenbrenner
*Attorney, Agent, or Firm*—William P. Green

[57] ABSTRACT

A rack structure is disclosed having a clip adapted for connecting a supported member, preferably forming part of a shelf, from an adjacent upright which is of a type having two opposite side walls and a wall extending transversely therebetween and joining the side walls at corners of the upright which contain openings. The clip extends along an inner side of the transverse wall and has opposite end portions projecting into the openings in the corners of the upright, with at least one end of the clip engaging a member supported thereby at a location laterally beyond the upright.

25 Claims, 9 Drawing Figures

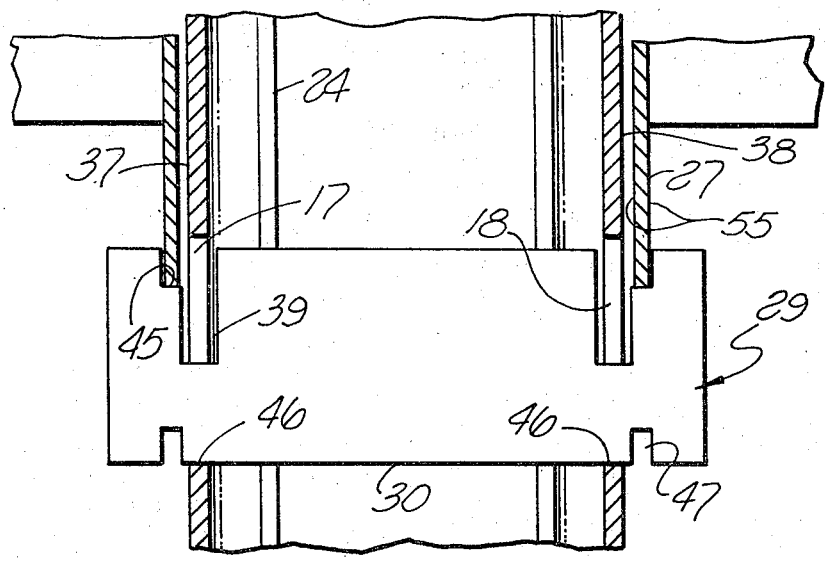
FIG. 5
FIG. 6
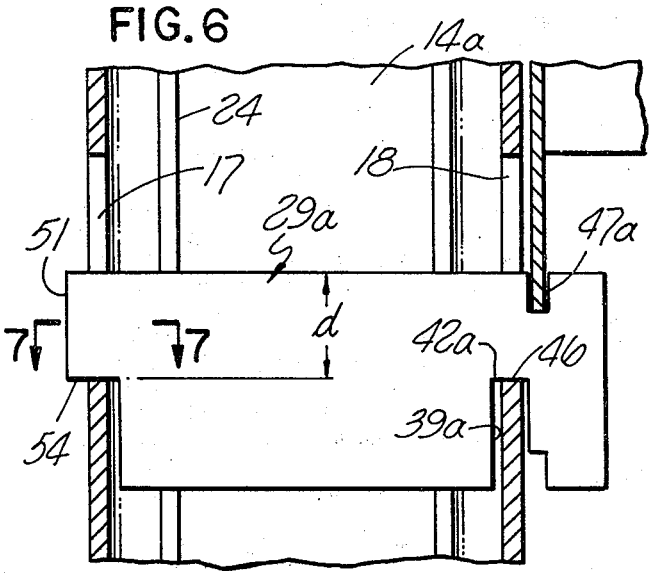
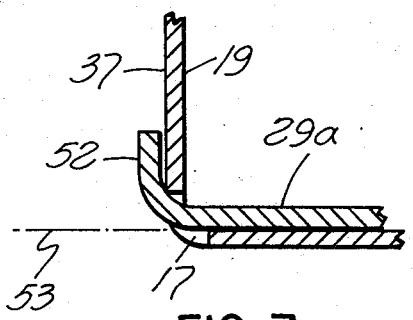
FIG. 7
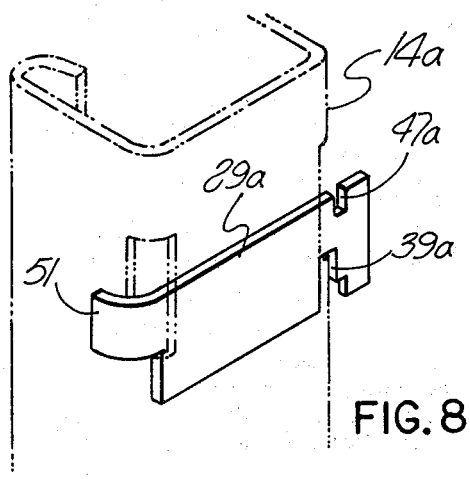
FIG. 8
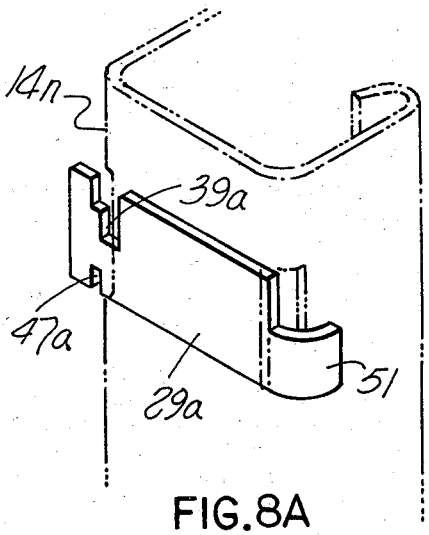
FIG. 8A

RACK STRUCTURE

BACKGROUND OF THE INVENTION

This invention relates to improved rack structures to be utilized as warehouse storage racks or for other similar purposes.

A known type of rack arrangement which is utilized commercially for supporting pallets in a warehouse includes a number of vertical support columns or uprights projecting upwardly at spaced locations and which are of a preferably U-shaped horizontal section having two spaced opposite side walls and a transverse wall extending therebetween and merging with the side walls at two corners ofthe upright. Vertical slots or openings are formed in the corners at vertically spaced locations, and horizontal members for interconnecting the uprights are supported by clips connectable into the corner openings. Each clip has two vertically spaced lugs projecting outwardly through two spaced openings in one of the corners to engage and support an end of one of the horizontal members. Such racks as heretofore provided are adapted to receive and support pallets at vertically spaced locations, so that stacks of merchandise or other items to be stored may then be supported on the various pallets.

SUMMARY OF THE INVENTION

The present invention provides a novel arrangement for adapting a pallet rack of the above discussed type for supporting at a desired level a number of shelves or other members on which relatively small quantities of items not loaded on a pallet can be supported. Thus, a lower level or levels of a rack assembly may be utilized for holding individual opened boxes of items from which customer orders can be assembled, while upper levels of the rack can receive only entire pallet loads. The overall rack assembly including both pallet and individual box storage areas thus becomes much more versatile and practical than a completely pallet type arrangement or one in which only individual boxes and no pallets can be stored.

These results are achieved by utilization of a unique type of clip which interfits with the mentioned openings or slots formed in the pallet rack uprights, and which affords very positive and effective support for horizontal shelves or other members extending between the uprights. The clips are of a type enabling very rapid assembly of a combined shelf and upright structure, preferably without the necessity for use of any bolts or other fasteners, and yet in a manner effectively and positively supporting the weight of the shelves and carried loads and rigidly retaining the shelves against lateral displacement relative to the uprights or separation therefrom. The overall assembly is a rigid structure which withstands any displacing forces, and which can be disassembled easily if desired. In addition, the arrangement allows successive shelves to be spaced any desired distance apart to custom design the rack at the time of assembly to satisfy the particular requirements encountered in an installation.

Structurally, each clip of an arrangement embodying the present invention is adapted to extend across the interior of one of the discussed uprights, from one of the generally parallel side walls of the upright to its opposite side wall, and at the inner side of the transverse wall which joins those side walls, with opposite end portions of the clip projecting into two of the openings formed in two different corners of the upright, in a relation supporting the clip by such reception of its ends in those openings. At least one of the ends of the clip has a portion projecting laterally beyond the corresponding side wall to the upright and adapted to engage and support an end of a coacting shelf element or other member at the outside of the upright. In most instances, both ends of the clip project beyond the corresponding side walls of the upright, to support two shelf members extending in opposite directions from the upright. When the upright is at the end of a rack assembly, one of its ends may be turned to engage an outer surface of one of the side walls of the upright in locating relation, without supporting a shelf or other element at that location. The interengagement between the clip and the upright and the supported shelf element or elements is such as to effectively interlock the parts against relative separation or lateral displacement and form an overrall rigid structure.

The clip preferably has downwardly facing notches which interfit with the side portions of the upright to prevent lateral movement of the clip relative to the upright, and desirably also has upwardly facing notches receiving portions of the shelf elements or other supported units in locating and retaining relation. Also, the clip may be designed for insertion into the openings in the upright in either of two relatively inverted conditions, and be adapted to support a shelf at different elevations relative to the upright in those different conditions of the clip.

BRIEF DESCRIPTION OF THE DRAWINGS

The above and other features and objects of the invention will be better understood from the following detailed description of the typical embodiment illustrated in the accompanying drawings in which:

FIG. 5 is a view similar to FIG. 4, but showing the clip in its inverted condition;

FIG. 6 is a vertical sectional view similar to FIG. 4 taken essentially at the location of the circle identified by the number 6 in FIG. 1;

FIG. 7 is an enlarged fragmentary horizontal section taken on line 7—7 of FIG. 6;

FIG. 8 is a perspective view representing the end clip of FIGS. 6 and 7; and FIG. 8A shows the end clip inverted and applied to the opposite end of the rack assembly.

DESCRIPTION OF THE PREFERRED EMBODIMENT

Figure 1:
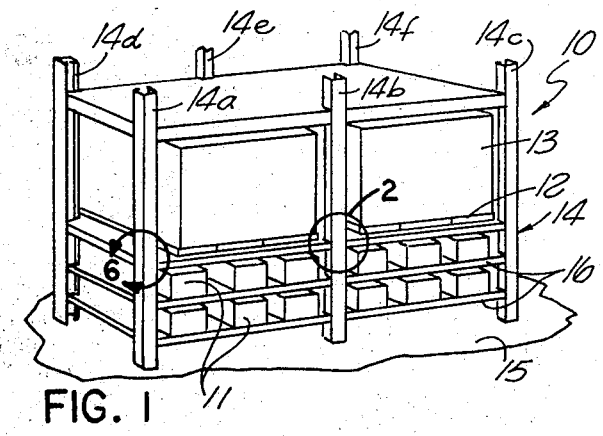
FIG. 1 is a fragmentary perspective representation of a rack structure constructed in accordance with the invention.

There is represented somewhat diagrammatically and framentarily at 10 in FIG. 1 a rack structure which is constructed in accordance with the present invention and is adapted for supporting individual cartons or other small items 11 at a lower level, and for supporting pallets 12 and stacks 13 of cartons or other load units carried by the pallets at upper levels of the rack assembly. The overall assembly may include parallel vertical uprights or columns 14 resting on the floor surface 15 and projecting upwardly therefrom and illustrated as including in FIG. 1 three front columns 14*a*, 14*b*, and 14*c* spaced laterally apart, and three corresponding similarly spaced rear columns 14*d*, 14*e*, and 14*f*. Transverse frame members 114 may interconnect and extend between successive uprights at vertically spaced locations to provide surfaces on which the pallets 12 can be placed.

In conventional prior arrangements employing uprights of the illustrated type, all of the various rectangular spaces between the uprights at different levels are normally adapted only for receiving pallet type loads. In order to enable the spaces between successive uprights at the lower level or perhaps the lower two levels in the present arrangement to receive the smaller cartons 11, the present invention provides means for supporting generally horizontal shelves 16 from the uprights, in positions of extension between the uprights. These shelves may be of a known automatic feed type adapted when a particular box is emptied to automatically deliver a next successive box forwardly to an accessable location by movement along an inclined roller assembly.

Figure 3:
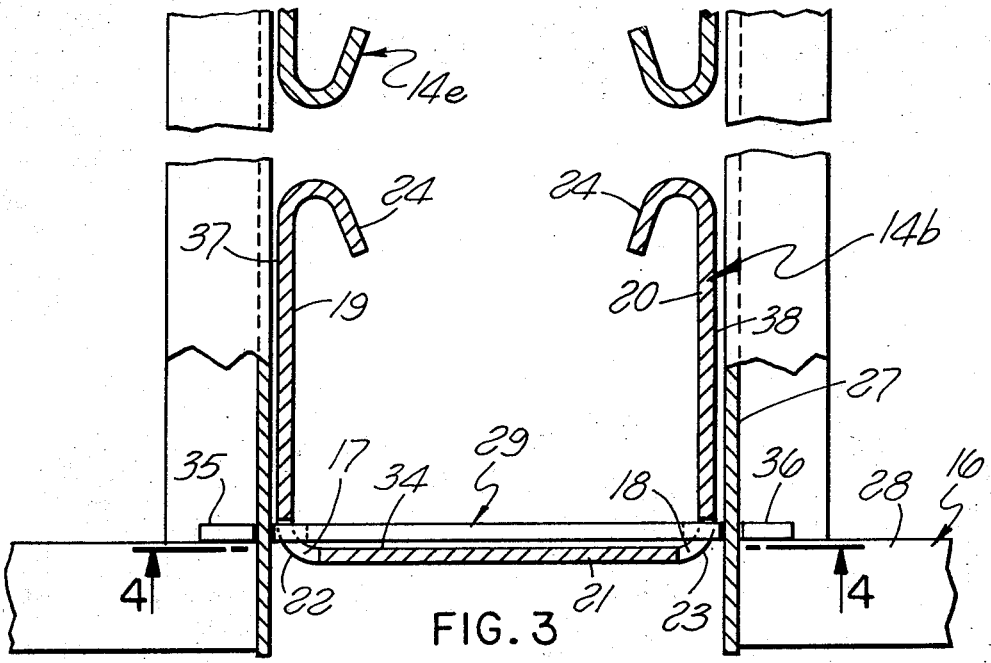
FIG. 3 is a fragmentary horizontal section taken on line 3—3 of FIG. 2.

All of the front uprights or support columns 14*a*, 14*b*, 14*c*, etc. may be identical, and have the horizontal sectional configuration represented for upright 14*b* in FIG. 3. This sectional configuration is uniform through the entire vertical extent of the upright except insofar as the section is interrupted at its corners by vertical slots 17 and 18 to be discussed in greater detail at a later point. The rear uprights 14*d*, 14*e*, and 14*f* may be identical with front uprights 14*a*, 14*b*, etc. except that the rear uprights are normally reversed relative to the front uprights as illustrated in FIG. 3, so that the closed faces of the upright are directed forwardly for the front uprights and rearwardly for the rear uprights.

Describing upright 14*b* in greater detail, it will be seen from FIG. 3 that this upright is of generally U-shaped horizontal section, having two parallel vertical opposite side walls 19 and 20 joined by a vertical front wall 21 extending between front edges of walls 19 and 20 and perpendicular thereto. Front wall 21 thus joins walls 19 and 20 at vertical corners 22 and 23 of the upright. The rear edges 24 of walls 19 and 20 may be curved as illustrated to form return bends acting to strengthen the overall upright structure.

Figure 2:
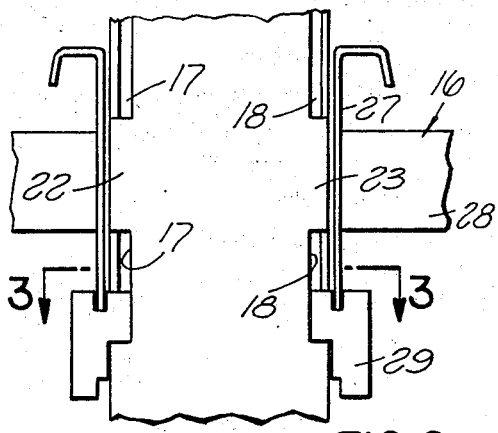
FIG. 2 is an enlarged fragmentary front elevational view showing the manner in which adjacent ends of two shelves are supported by a front upright of the rack structure, with FIG. 2 being taken at the location represented by the circle identified by the number 2 in FIG. 1.

As seen best in FIG. 2, a series of vertically spaced vertically elongated slots or openings 17 are formed in corner portion 22 of upright 14*b* (and each of the other uprights), with these vertically elongated openings being spaced apart equal distances and distributed along the entire vertical extent of the upright from its lower extremity to its upper end. The second corner 23 of the upright has a similar series of slots 18 which are also vertically elongated and of the same vertical extent as slots or openings 17, and aligned horizontally therewith.

Each of the shelf units 16 may have a rigid framework including two parallel vertical rigid end walls 27 joined by rigid members 28 to which the remainder of the shelf structure is mounted for supporting cartons 11. In the assembled condition of the parts, the vertical end walls or plates 27 of shelves 16 are received adjacent and parallel to side walls 19 and 20 of the uprights, and are supported in that position by clips 29 of the configuration illustrated in FIG. 4. Each such clip is receivable in either the normal position illustrated in FIG. 4 or the inverted position illustrated in FIG. 5 to support the shelves at two different levels relative to a particular set of openings in the uprights. These different levels enable the shelves to be positioned for reception of different size cartons vertically between successive shelves, and enable the rear portion of the shelf to be elevated slightly above its forward portion for automatically feeding cartons forwardly by gravity on the shelves and along rollers carried thereby.

Figure 4:
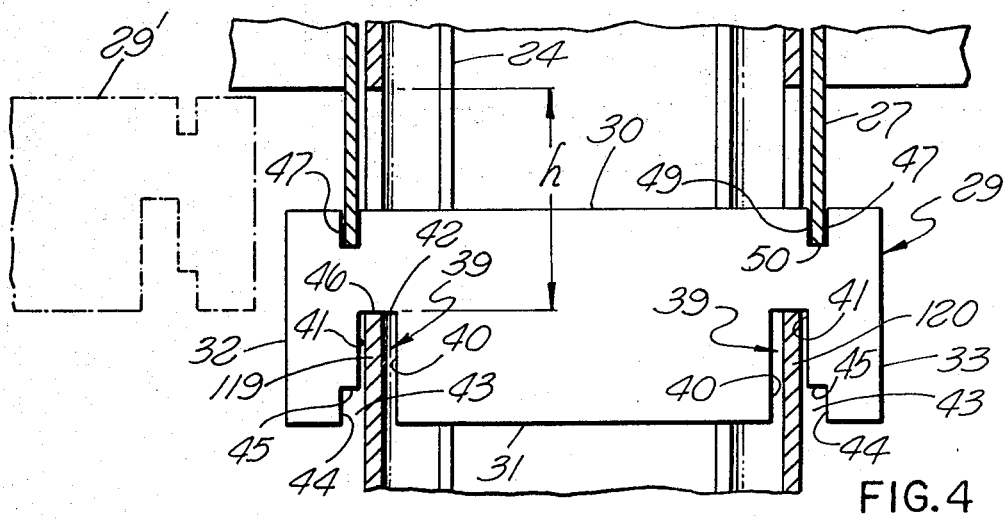
FIG. 4 is a vertical section taken on line 4—4 of FIG. 3.

Describing clip 29 in the FIG. 4 position thereof, it is noted that the clip is preferably formed of a single essentially rectangular piece of typically flat sheet metal, defined by horizontal parallel top and bottom edges 30 and 31 and vertical parallel opposite end edges 32 and 33. In the FIG. 4 position, this flat clip element 29 extends parallel to and engages the planar vertical back surface 34 of front wall 21 of the upright, to locate the clip against forward movement relative to the upright. Opposite end portions 35 and 36 of the clip project through a pair of corresponding openings 17 and 18 formed in corners 22 and 23 of the upright, and project laterally beyond the planes of the outer parallel planar surfaces 37 and 38 of walls 19 and 20 to engage and support ends of two of the shelves 16. These end portions 35 and 36 of clip 29 contain two downwardly facing notches or recesses 39 defined by inner vertical edges 40, second vertical edges 41 spaced horizontally from edges 40, and upper end surfaces 42 forming horizontal shoulders at the tops of notches, with the notches having widened lower portions 43 defined by vertical edges 44 and horizontal downwardly facing shoulders 45 spaced beneath the level of upper end shoulders 42. The vertical dimension of clip 29 between its top and bottom edges 30 and 31 is less than the vertical height h of slots 17 and 18 in the upright, so that the clip may be inserted from the position represented in broken lines at 29' in FIG. 4 through one of the openings 17 and along the rear surface 34 of front wall 21 of the upright and then through a corresponding opening or slot 18 at the opposite side of the upright (or vice versa), and to a location directly above the full line position of the clip in FIG. 4, so that the clip may then be lowered to that FIG. 4 full line position in which the portions 119 and 120 of the upright directly beneath slots 17 and 18 are received within the upper narrower portions of downwardly facing notches 39 in the clip, between edges 40 and 41 of those notches, in an interfitting relation effectively retaining the clip again :t lateral movement relative to the upright from the FIG. 4 position. In that condition, the upper horizontal edges 46 of the portions of the upright directly beneath the apertures form upwardly facing shoulders which engage the downwardly facing shoulders 42 at the upper ends of notches 39 to support the clip and any parts connected thereto from th upright.

The upper horizontal edge 30 of clip 29 is interrupted near opposite ends of the clip by two upwardly facing notches 47 which in the FIG. 4 position are received closely adjacent the planes of the outer surfaces 37 and 38 of side walls 19 and 20 of the upright, and which are defined by spaced parallel vertical edges 49 and upwardly facing shoulders 50 at the lower extremities of the notches. The end plates 27 of shelves 16 have their lower edges dimensioned to be closely received within notches 47 in the upper sides of the end portions of clip 29 to support plates 27 and thus the corresponding ends of the shelves 16 on upwardly facing shoulders 50 at the bottoms of notches 47, while confining the plates 27 against lateral movement from notches 47 by engagement with the opposite sides 49 of those notches.

At the levels of each of the shelves 16, a clip 29 of the described type is engaged with and supported by each of the uprights 14*a*, 14*b*, 14*c*, etc., so that each of the shelves has its end plates 27 supported from and retained in fixed position relative to two uprights at each of its ends. The shelves are thus very rigidly retained in the FIG. 1 positions and the entire structure is interlocked in a manner maintaining the overall integrity of the assembly unless one of the shelves is purposely removed.

All of the clips utilized at the different uprights may be identical except at the location of the end uprights such as those designated by the numbers 14*a* an 14*d* in FIG. 1, at which locations a changed form of clip may be employed as represented at 29*a* in FIGS. 6, 7, 8 and 8*a*. This clip may be the same as clip 29 except that its left end as illustrated in FIG. 6 does not contain the downwardly facing notch 39 or upwardly facing notch 47, but rather has an end portion 51 which projects through one of the vertical slots 17 of the engaged upright, and then is turned to form a portion 52 extending perpendicular to the plane 53 of the remainder of the clip and parallel to the outer surface 37 of side wall 19 of the upright, to engage that surface 37 when the right hand end portion of clip 29*a* is in the previously discussed interfitting engagement with the notched area at the right front corner of upright 14*a*. The vertical dimension d of the turned flange end 52 of clip 29*a* may correspond to the vertical distance between upper edge 30 and shoulders 42 in FIG. 4, so that the horizontal undersurface 54 of portion 51 forms a downwardly facing shoulder serving the function of one of the shoulders 42 in FIG. 4 and aligned with the shoulder 42*a* at the upper end of notch 39*a* at the right side of the clip to support clip 29*a* in a position in which its upper and lower edges are directly horizontal. The plate 27 at the end of one of the shelves 16 can then be supported from the right end of clip 29*a* in the manner discussed in connection with clip 29, while the engagement of turned flange 52 with the left side of the upright in FIGS. 6 and 7 assures against rightward movement of the left end of the clip and maintains both ends of the clip in positions of reception within two of the notches in the two corners of the upright.

If it is desired to support the shelves 16 at a position slightly above that of FIG. 4 relative to one or more of the uprights, this result may be attained by inserting clips 29 into the same slots 17 and 18 of the upright as in FIG. 4, but with the clip inverted, so that the initially downwardly facing notches 39 now face upwardly, and the initially upwardly facing notches 47 face downwardly, as seen in FIG. 5. The notches 47 are so located that in this inverted condition they are not aligned vertically with the side walls 19 and 20 of the upright, with the result that the upwardly facing shoulders or top edges 46 on the portions of the side walls directly beneath the apertures are not received within notches 47, but rather engage horizontal edges 30 of the clip just laterally inwardly of notches 47, to thereby support the clip on those shoulders 46. Shelves 16 are then supported on the inverted clip by insertion of the vertical end plates 27 of the shelves downwardly into the widened portions 43 of notches 39, to engage shoulders 45 in a relation supporting plates 27 and the remainder of the shelf structures on those shoulders 45. Engagement of the vertical planar opposite side surfaces 55 of each plate 27 with the outer surface 37 or 38 of an upright and with the edge 44 at one side of a notch 39 confines plates 27 closely between edges 44 and the sides of the upright, in a relation interlocking the parts in the condition represented in FIG. 5 and preventing lateral movement of the clip 29 either leftwardly or rightwardly from that position and relative to the upright or shelves to thus assure maintenance of the clip in a position in which it is supported on shoulders 46 of the upright and acts to support the shelves on shoulders 45. The clip 29*a* of FIG. 6 may be similarly inverted, with its edge 30*a* engaging shoulders 46 at both sides of the upright to support the clip in a proper condition, and with end flange 52 engaging outer surface 38 of the right side wall of an end upright to prevent leftward movement of the clip beyond the position of FIG. 8A and thus assure proper support of the shelf at the left side of the upright. The clip 29*a* when used at the left end of a rack assembly (FIG. 8) can thus support a shelf at a lower level, and when used at the right end of the rack assembly (FIG. 8A), can support a shelf at a higher level. An opposite hand clip which is the same as clip 29*a* but the mirror image thereof, with notches 39*a* and 47*a* formed near its left end as viewed in FIG. 6 and with portion 51–52 formed at its right end, is used to support a shelf at a lower level at the right end of a rack assembly and at a higher level at the left end of the rack assembly.

To summarize the manner of assembly of the rack structure illustrated in FIG. 1, the vertical columns and the upper pallet supporting cross-members 114 may first be installed and connected together to form a rigid framework. Thereafter, clips 29 and 29*a* (and clips which are the mirror image of clips 29*a* as discussed) may be inserted into slots 17 and 18 of the various uprights to positions corresponding to FIGS. 4 and 6, or the inverted positions of FIGS. 5 and 8A. The shelves 16 are then inserted into position, with their end plates 27 being received within and supported by notches 47, or being supported at elevated positions on shoulders 45 as represented in FIGS. 5 and 8A. In either condition, the interfitting relationship between the clips and uprights and end plates of the shelves acts without use of bolts or other fasteners to interlock the parts in the positions illustrated and against shifting movement from those positions or inadvertant separation of the parts. At the same time, however, the parts may be easily disassembled or rearranged for different shelf levels when desired.

While certain specific embodiments of the present invention have been disclosed as typical, the invention is of course not limited to these particular forms, but rather is applicable broadly to all such variations as fall within the scope of the appended claims.

I claim:

1. A rack structure comprising:

an upright having spaced generally parallel first and second walls, and a third wall extending therebetween and generally perpendicular thereto and merging with said first and second walls at two corners of the upright;

said upright containing first and second openings at said two corners respectively;

a clip extending between said first and second walls at an inner side of said third wall and having opposite first and second end portions projecting into and supported within said first and second openings respectively of the upright; and a shelf received at one side of said upright and including a member supported by said first end portion of said clip laterally outwardly beyond said first wall;

said second end portion of said clip being turned generally perpendicular to the major portion of the clip for reception at an outer side of said second wall at a location limiting movement of the clip toward said first wall of the upright.

2. A rack structure as recited in claim 1, in which said first end portion of the clip contains a downwardly facing notch for receiving a portion of the upright beneath said first opening in an interfitting relation preventing lateral movement of the clip relative to the upright.

3. A rack structure as recited in claim 2, in which said first end portion of the clip contains an upwardly facing notch for receiving a portion of said member and locating it against lateral movement.

4. A rack structure as recited in claim 3, in which said downwardly facing notch has a lower widened portion forming a shoulder beneath the upper end of said downwardly facing notch and adapted to engage a member in an inverted condition of the clip and to support the member at an elevated location.

5. A rack structure comprising:

an upright having spaced generally parallel first and second walls, and a third wall extending therebetween and merging with said first and second walls at two corners:

said upright containing first and second openings at said two corners respectively;

a clip extending between said first and second walls at an inner side of said third wall and having opposite first and second end portions projecting into and supported within said first and second openings respectively; and a member supported by said first end portion of said clip laterally outwardly beyond said first wall;

said first end portion of said clip containing a downwardly facing notch for receiving and interfitting with a portion of the upright beneath said first opening and having a shoulder at an upper end of the notch engageable with the upright to support the clip therefrom, said notch having a widened lower portion forming a second shoulder lower than said first shoulder and engageable with a member in supporting relation in inverted condition of the clip.

6. A rack structure as recited in claim 5, in which said first end portion of said clip has an upwardly facing notch for receiving a portion of said member in supporting relation.

7. A rack structure as recited in claim 6, in which said second end portion of said clip is turned to engage an outer surface of said second wall of the upright.

8. For use in a rack structure including an upright having spaced generally parallel first and second walls and a third wall extending therebetween and merging with said first and second walls at corners containing first and second openings respectively, a clip comprizing:

a clip body adapted to extend between said first and second walls at an inner side of said third wall and having opposite first and second end portions adapted to project into and be supported within said first and second openings respectively;

said first end portion being adapted to project laterally beyond said first end walls and support a member at an outer side thereof;

said clip body containing a downwardly facing notch for receiving and interfitting with a portion of the upright beneath said first opening and having a shoulder at an upper end of the notch engageable with the upright to support the clip therefrom, said notch having a widened lower portion forming a second shoulder lower than said first shoulder and engageable with a member in supporting relation in inverted condition of the clip.

9. A clip as recited in claim 8, in which said first end portion of said clip has an upwardly facing notch for receiving a portion of said member in supporting relation.

10. A clip as recited in claim 9, in which said second end portion of said clip is turned to engage an outer surface of said second wall of the upright.

11. A clip as recited in claim 9, in which said second end portion of said clip has a downwardly facing notch for engagement with said second wall of the upright and having a widened portion for supporting a member in an inverted position of the clip, and said second end portion of the clip has an upwardly facing notch for receiving a portion of a member in supporting relation.

12. A clip as recited in claim 8, in which said second end portion of said clip body is adapted to project laterally beyond said second wall of the upright and support a second member at an outer side thereof.

13. A clip as recited in claim 8, in which said second end portion of said clip body is turned to extend alongside and engage an outer side of said second wall of the upright.

14. A clip as recited in claim 8, in which said clip body is adapted to extend through said openings in either of two inverted positions, and to support a member at two different elevations in said two positions respectively.

15. A rack structure comprising:

an upright having spaced generally parallel first and second walls, and a third wall extending therebetween and merging with said first and second walls at two corners;

said upright containing first and second openings at said two corners respectively;

a clip extending between said first and second walls at an inner side of said third wall and having opposite first and second end portions projecting into and supported within said first and second openings respectively;

said clip having an intermediate portion between said opposite end portions thereof which is received closely adjacent a portion of said third wall at a location between said two corner openings and is engageable with said portion of the third wall at that location between the openings in a relation confining the clip against movement in a first horizontal direction toward the third wall, with the clip being confined against movement in an opposite second horizontal direction away from said portion of said third wall by extension through said openings;

said clip having shoulders engageable with at least one of said first and second walls beneath at least one of said openings in a relation retaining the clip against longitudinal movement in a third horizontal direction perpendicular to said first and second directions; and a member supported by said first end portion of said clip laterally outwardly beyond said first wall.

16. A rack structure as recited in claim 15, in which said member is a portion of a shelf structure supported in part through said member by said first end portion of said clip.

17. A rack structure as recited in claim 15, including a second member supported by said second end portion of said clip laterally outwardly beyond said second wall.

18. A rack structure as recited in claim 15, in which said clip is adapted to be supported by said upright with said opposite end portions projecting into said openings in either of two relatively inverted positions, and is adapted to support a member through said first end portion of said clip at two different elevations relative to the upright in said two relatively inverted positions of the clip.

19. A rack structure as recited in claim 15, in which said clip contains a downwardly facing notch receiving a portion of said upright beneath one of said openings in an interfitting relation locking the clip against lateral movement relative to the upright.

20. A rack structure as recited in claim 15, in which said clip has an upwardly facing notch adapted to receive a portion of said member in a relation supporting the member and locating it relative to the clip.

21. A rack structure as recited in claim 15, in which said second end portion of said clip is turned to engage an outer side of said second wall of the upright in a relation limiting lateral movement of the clip in one direction relative to the upright.

22. A rack structure comprising:

an upright having spaced generally parallel first and second walls and a third wall extending therebetween and generally perpendicular thereto and merging with said first and second walls at two corners of the upright;

said upright containing vertically spaced first openings at a first of said corners and similar vertically spaced second openings at a second of said corners;

a clip extending between said first and second walls of the upright at an inner side of said third wall and having opposite first and second end portions projecting through and supported within said first and second openings respectively;

said clip having an intermediate portion between said opposite end portions thereof which is received closely adjacent a portion of said third wall at a location between said two corner openings and is engageable with said portion of the third wall at that location between the openings in a relation confining the clip against movement in a first horizontal direction toward the third wall, with the clip being confined against movement in an opposite second horizontal direction away from said portion of said third wall by extension through said openings;

said clip having shoulders engageable with at least one of said first and second walls beneath at least one of said openings in a relation retaining the clip against longitudinal movement in a third horizontal direction perpendicular to said first and second directions; and two shelves at opposite sides of said upright and having members supported and located laterally by said first and second end portions respectively of said clip laterally outwardly beyond said first and second walls respectively.

23. A rack structure as recited in claim 22, in which said two end portions of said clip contain downwardly facing notches receiving and interfitting with portions of said first and second walls beneath two of said first and second openings, in a relation locating the clip against lateral movement relative to the support.

24. A rack structure as recited in claim 23, in which said opposite end portions of said clip contain two upwardly facing notches adapted to receive portions of said shelf members adjacent said upright and locate said members against lateral movement relative to the upright and clip.

25. A rack structure as recited in claim 24, in which said downwardly facing notches have lower widened portions forming shoulders beneath the upper ends of those notches and adapted to support said members in an inverted position of the clip and at levels higher than when the clip in not inverted.

* * * * *